US005232826A

United States Patent [19]

Bucci et al.

[11] Patent Number: 5,232,826

[45] Date of Patent: Aug. 3, 1993

[54] INFRARED SENSITIVE SILVER HALIDE PHOTOGRAPHIC ELEMENTS

[75] Inventors: Marco Bucci, Genoa; Ivano Delprato, Rocchetta Di Cairo Montenotte; Giorgio Spazzapan, Savona, all of Italy

[73] Assignee: Minnesota Mining and Manufacturing Company, St. Paul, Minn.

[21] Appl. No.: 671,460

[22] Filed: Mar. 19, 1991

[30] Foreign Application Priority Data

Mar. 22, 1990 [IT] Italy ..... 19767 A/90

[51] Int. Cl.[5] ..... G03C 1/08; G03C 1/34

[52] U.S. Cl. ..... 430/572; 430/576; 430/600; 430/611; 430/614; 430/944

[58] Field of Search ..... 430/572, 576, 600, 611, 430/614, 944

[56] References Cited

U.S. PATENT DOCUMENTS 4,780,404 10/1988 Sills et al. ..... 430/572
5,108,872 4/1992 Inoue et al. ..... 430/264

FOREIGN PATENT DOCUMENTS 0295079 12/1988 European Pat. Off. .
0366300 5/1990 European Pat. Off. .
3307506 9/1984 Fed. Rep. of Germany .
62-270949 11/1987 Japan .
63-37348 2/1988 Japan .

OTHER PUBLICATIONS

Advanced Organic Chemistry, 3rd Edition, Jerry March, John Wiley and Sons, pp. 237-239.

*Primary Examiner*—Janet C. Baxter
*Attorney, Agent, or Firm*—Gary L. Griswold; Walter N. Kirn; Mark A. Litman

[57] ABSTRACT

An infrared sensitive silver halide photographic element is disclosed comprising a support and at least one silver halide emulsion layer spectrally sensitized to the infrared portion of the electromagnetic spectrum. In particular, an infrared sensitive silver halide color photographic element, capable of providing full color images without exposure to corresponding visible radiation, is disclosed, said element comprising at least three silver halide emulsion layers on a substrate, each associated with different photographic color image forming materials, such as color couplers capable of forming dyes of different colors upon reaction with an oxidized color photographic developer, diffusing dyes, bleachable dyes, or oxidable leuco dyes. The three emulsion layers are sensitized to three different portions of the electromagnetic spectrum with at least one layer sensitized to radiation within the infrared region of the electromagnetic spectrum. The infrared sensitive element is characterized in that at least one infrared sensitized emulsion layer is associated with a 5-arylamino-1,2,3,4-thiatriazole compound wherein the aryl group has at least one electron-attracting group substituent. The infrared sensitive color photographic element having an effective amount of said compound therein has high sensitivity to infrared radiation and undergoes less change in sensitivity during storage.

4 Claims, No Drawings

INFRARED SENSITIVE SILVER HALIDE PHOTOGRAPHIC ELEMENTS

FIELD OF THE INVENTION

This invention relates to silver halide photographic elements sensitive to infrared radiation. In particular, the present invention relates to color photographic elements having at least three silver halide emulsion layers associated with color image providing materials, each emulsion layer being sensitized to a different region of the electromagnetic spectrum and at least one emulsion layer being sensitized to radiation within the infrared region of the electromagnetic spectrum, wherein at least one infrared sensitized emulsion layer is associated with at least one 5-arylamino-1,2,3,4-thiatriazole derivative.

BACKGROUND OF THE ART

Dyes which have been capable of sensitizing silver halide emulsions to infrared regions of the electromagnetic spectrum have been known for many years. Merocyanine dyes and cyanine dyes, particularly those with longer bridging groups between cyclic moieties, have been used for many years to sensitize silver halide to the infrared. U.S. Pat. Nos. 3,619,154, 3,682,630, 2,895,955, 3,482,978, 3,758,461 and 2,734,900; and GB Pat. Nos. 1,192,234 and 1,188,784 disclose well-known classes of dyes which sensitize silver halide to portions of the infrared region of the electromagnetic spectrum. U.S. Pat. No. 4,362,800 discloses dyes to sensitize inorganic photoconductors to the infrared, and these dyes are also effective sensitizers for silver halide.

With the advent of lasers, and particularly solid state laser diodes emitting in the infrared region of the electromagnetic spectrum (e.g., 780 to 1500 nm), the interest in infrared sensitization has greatly increased. Many different processes and articles useful with laser diodes have been proposed U.S. Pat. No. 4,011,083 discloses photographic elements having a defined pAg, infrared spectral sensitizing methine dyes of defined polarographic cathodic halfwave potential and silver complexing azaindenes, said elements having higher speed in the spectrally sensitized region. U.S. Pat. No. 4,416,522 proposes daylight photoplotting apparatus for the infrared exposure of film. This patent also generally proposes a film comprising three emulsion layers sensitized to different portions of non-visible portions of the electromagnetic spectrum, including the infrared. The film description is quite general and the concentration of image wise exposure on each layer appears to be dependent upon filtering of the radiation by the apparatus prior to its striking the film surface. U.S. Pat. No. 4,619,892 describes a photographic element capable of providing full color images without exposure to corresponding visible radiation, said element comprising at least three silver halide emulsion layers on a substrate, each associated with different photographic color image forming materials and sensitized to three different portions of the electromagnetic spectrum with at least two layers sensitized to different regions of the infrared region of the electromagnetic spectrum.

It is also known that the addition of specific organic compounds to a silver halide photographic material in addition to the spectrally sensitizing dyes can increase the spectrally sensitized speed of the emulsion by more than one order of magnitude. This is known as a supersensitizing effect. As organic compounds for supersensitization of infrared sensitized silver halide emulsions which are conventionally known, there are illustrated, for example, triazine derivatives described in U.S. Pat. Nos. 2,875,058 and 3,695,888, mercapto compounds described in U.S. Pat. No. 3,457,078, thiourea compounds described in U.S. Pat. No. 3,458,318, pyrimidine derivatives described in U.S. Pat. No. 3,615,632, azaindene compounds described in U.S. Pat. No. 4,578,347, thiazolium and oxazolium salts described in U.S. Pat. No. 4,596,767, combinations of supersensitizers described in U.S. Pat. No. 4,603,104 and thiatriazoles described in U.S. Pat. No. 4,780,404.

Photographic elements comprising silver halide emulsion layers sensitized to infrared regions of the electromagnetic spectrum, in particular infrared sensitized color photographic elements associated with photographic color image forming materials, are generally liable to undergo changes in sensitivity if stored under different conditions of humidity and temperature. Such change in photographic sensitivity is a critical problem in the use of infrared sensitized photographic materials. It is well known that commercially available photographic materials having sensitivity in the infrared region are unstable in sensitivity and require special caution for preservation thereof, such as storage in a refrigerator. Conventionally known stabilizers such as 1-phenyl-5-mercaptotetrazole are not effective for improving stability of infrared sensitized photographic materials. Therefore, a need exists to develop a technique wich specifically improves the stability on storage of infrared sensitized emulsions.

U.S. Pat. No. 3,457,078 describes the use of mercapto substituted oxazine, oxazole, thiazole, thiadiazole, imidazole, or tetrazole, the mercapto substituted compound further containing an electronegative substituent, as supersensitizers and antifoggants in combination with certain cyanine dyes. 1-Phenyl-2-mercaptotetrazole is a suitable substance disclosed in said patent.

U.S. Pat. No. 4,780,404 describes the use of 5-substituted-1,2,3,4-thiatriazoles, wherein the 5-substituent of said 5-substituted-1,2,3,4-thiatriazoles is bonded to said thiatriazole through an amine group, as supersensitizers in silver halide emulsions spectrally sensitized to the infrared portion of the electromagnetic spectrum.

SUMMARY OF THE INVENTION

An infrared sensitive photographic element is disclosed which comprises at least one silver halide emulsion layer spectrally sensitized to the infrared portion of the electromagnetic spectrum. In particular, the element comprises at least three silver halide emulsion layers on a substrate, each associated with different photographic color image forming materials, such as color couplers capable of forming dyes of different colors upon reaction with an oxidized color photographic developer, diffusing dyes, bleachable dyes, or oxidizable leuco dyes, the three emulsion layers being sensitized to three different portions of the electromagnetic spectrum with at least one layer sensitized to radiation within the infrared region of the electromagnetic spectrum. The element is characterized in that at least one infrared sensitized emulsion layer is associated with a 5-arylamino-1,2,3,4-thiatriazole compound in which the aryl group has at least one electron-withdrawing group substituent.

The infrared sensitive color photographic element having an effective amount of said compound therein has high sensitivity to infrared radiation and undergoes less change in sensitivity during storage.

DETAILED DESCRIPTION OF THE INVENTION

An infrared sensitive photographic element is herein described which element comprises a support having coated on at least one surface thereof one or more silver halide emulsion layers, at least one silver halide emulsion layer being spectrally sensitized to the infrared portion of the electromagnetic spectrum. In particular, an infrared sensitive color photographic element is herein described, which is capable of providing a full color image or three color images by exposure of at least two silver halide emulsion layers to radiation outside the visible region of the electromagnetic spectrum, which element comprises a support, and coated on one side of said support at least three silver halide emulsion layers, each of said silver halide emulsion layers being associated with means for forming a single color image of a different color dye, said three emulsion layers being sensitized to three different portions of the electromagnetic spectrum with at least one layer sensitized to radiation within the infrared region of the electromagnetic spectrum. The element is characterized in that at least one infrared sensitized emulsion layer is associated with an 5-arylamino-1,2,3,4-thiatriazole compound substituted in the aryl group by at least one electron-withdrawing group. As employed herein the term "electron-withdrawing group" refers to groups that have a multiple-bonded electronegative atom directly connected to an unsaturated system which are said to be electron-withdrawing by the resonance effect (—M groups). Groups with —M effects are well known in the chemical literature, such as those listed in Advanced Organic Chemistry, J. March, Third Edition, page 238, Table 1.

Preferably, the compounds of the present invention are represented by the structural formula

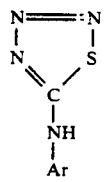

(I)

wherein Ar is an aryl group bearing at least one electron-withdrawing group (as a substituent). More preferably, the aryl group is a phenyl group and the electron-withdrawing groups are selected from the group consisting of nitro, cyano, carbamoyl (preferably, a $C_1$ to $C_4$ straight or branched alkylaminocarbonyl or an unsubstituted or substituted phenylaminocarbonyl group), sulfamoyl (preferably, a $C_1$ to $C_4$ straight or branched alkylaminosulfonyl or an unsubstituted or substituted phenylaminosulfonyl group), acylamino (preferably, a $C_1$ to $C_4$ straight or branched alkylcarbonamido or an unsubstituted or substituted phenylcarbonamido group), sulfonamido (preferably, a $C_1$ to $C_4$ straight or branched alkylsulfonamido or an unsubstituted or substituted phenylsulfonamido group), acyl (preferably, a $C_1$ to $C_4$ straight or branched alkylcarbonyl or an unsubstituted or substituted phenylcarbonyl group) and alkoxycarbonyl (preferably, a $C_1$ to $C_4$ straight or branched alkoxycarbonyl).

Still more preferably, the compounds of the present invention are represented by the structural formula (I) wherein Ar is a phenyl group bearing one or more $C_1$ to $C_4$ straight or branched alkoxycarbonyl groups.

When the term "group" is used in this invention to describe a chemical compound or substituent, the described chemical material includes the basic group and that group with conventional substitution. Where the term "moiety" is used to describe a chemical compound or substituent, only an unsubstituted chemical material is intended to be included. For example, "alkyl group" includes not only such alkyl moieties as methyl, ethyl, octyl, stearyl, etc., but also such moieties bearing substituent groups such as halogen, cyano, hydroxyl, nitro, amine, carboxylate, etc. On the other hand, "alkyl moiety" includes only methyl, ethyl, octyl, stearyl, cyclohexyl, etc.

Specific examples of aryl groups substituted with one or more electron-withdrawing groups are, for example, a 4-nitrophenyl group, 2-nitro-4-N,N-dimethylsulfamoylphenyl group, 2-N,N-dimethylsulfamoyl-4-nitrophenyl group, 2-cyano-4-methylsulfonylphenyl group, 2,4-dinitrophenyl group, 2,4,6-tricyanophenyl group, 2-nitro-4-N,N-dimethylcarbamoylphenyl group, 2,4-dimethanesulfonylphenyl group, 3,5-dinitrophenyl group, 2-chloro-4-nitro-5-methylphenyl group, 2-nitro-3,5-dimethyl-4-tetradecylsulfonylphenyl group, 2,4-dinitronaphthyl group, 2-ethylcarbamoyl-4-nitrophenyl group, 3-acetamidophenyl group, 2-acetyl-4-niphenyl group, 2,4-diacetylphenyl group, 2-nitro-4-trifluoromethyl phenyl group, 4-methoxycarbonyl, 4-ethoxycarbonyl phenyl group.

The compounds of the present invention represented by the general formula (I) may be added in any effective supersensitizing and stabilizing amount to the photographic emulsion. The concentration of said compounds can vary significantly in photographic emulsions. A generally useful range would be from 0.008 to 0.28 g per mol of silver. A more preferred range would be from 0.015 to 0.150 g per mol of silver. The compounds of the present invention can be directly dispersed in the photographic emulsion, or may be dissolved in a suitable solvent (e.g., water, methyl alcohol, ethyl alcohol, propanol, methyl cellosolve, acetone, etc.) or in a mixture of these solvents and added as a solution to the emulsion. In addition, said compounds can be added to the emulsion as a solution or as a colloid dispersion according to the processes for adding sensitizing dyes, as known to those skilled in the art.

Any spectral sensitizing dye known to sensitize silver halide emulsions to infrared portion of the electromagnetic spectrum may be used in the practice of the present invention with the stabilizer compounds of the present invention. The infrared portion of the electromagnetic spectrum is given various ranges, but is generally considered to be between 750 and 1500 nm which overlaps a small portion of the visible regions of the electromagnetic spectrum (e.g., about 750–780 nm). Useful dyes for this purpose tend to be merocyanines, cyanines and especially tricarbocyanines. Such dye sensitizers for the infrared are described for example in U.S. Pat. Nos. 3,457,078, 3,619,154, 3,682,630, 3,690,891, 3,695,888, 4,030,932 and 4,367,800. The preferred classes of dyes are the tricarbocyanines such as 3,3'-dialkylthiatricarbocyanines, thiatricarbocyanines (especially with rigidized chains), selenotricarbocyanines, and enamine tricarbocyanines.

Preferred classes of dyes according to the present invention are represented by the following general formula (II) or (III):

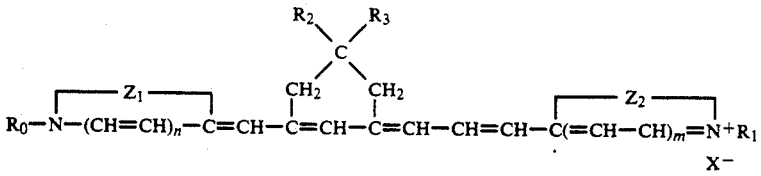

(II)

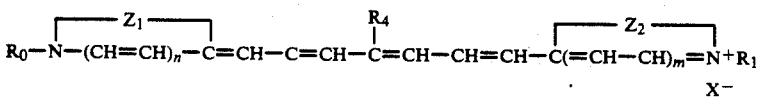

(III)

wherein:

$R_0$ and $R_1$ can be a substituted alkyl group or a non-substituted alkylgroup having from 1 to 8 carbon atoms such as, for example, methyl, ethyl, propyl, butyl, amyl, benzyl, octyl, carboxymethyl, carboxyethyl, sulfopropyl, carboxypropyl, carboxybutyl, sulfoethyl, sulfoisopropyl and sulfobutyl groups;

$X^-$ is any acid anion such as, for example, chloride, bromide, iodide, perchlorate, tri-iodate, sulfamate, thiocyanate, p-toluenesulfonate and benzenesulfonate;

$Z_1$ and $Z_2$ are independently the non-metallic atoms necessary to complete an aromatic heterocyclic nucleus chosen within those of the thiazole series, benzothiazole series, (1,2-d)-naphthothiazole series, (2,1-d)-naphthothiazole series, oxazole series, benzoxazole series, selenazole series, benzoselenazole series, (1,2-d)-naphthoselenazole series, (2,1-d)-naphthoselenazole series, thiazoline series, 4-quinoline series, 2-pyridine series, 4-pyridine series, 3,3'-dialkyl-indolenine series (wherein alkyl has a meaning known to those skilled in the art including alkyl groups having 1 to 12 carbon atoms), imidazole series and benzimidazole series.

More particularly and preferably, the present invention refers to dyes of the type above indicated in which both heterocyclic nuclei are of the benzothiazole series.

$R_2$ and $R_3$ each represent a hydrogen atom, or an alkyl group having 1 to 5 carbon atoms such as a methyl group or an ethyl group; $R_4$ represents a hydrogen atom, a hydroxy group, a carboxy group, an alkyl group having 1 to 5 carbon atoms, an unsubstituted or substituted aryl group, an acyloxy group shown by

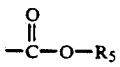

wherein $R_5$ represents an alkyl group having 1 to 5 carbon atoms, a phenyl group, or a substituted phenyl group.

The infrared sensitizing dyes of the present invention are incorporated in the silver halide photographic emulsion in a content of $5\times10^{-7}$ mol to $5\times10^{-3}$ mol, preferably $1\times10^{-6}$ mol to $1\times10^{-3}$ mol, more preferably $2\times10^{-6}$ mol to $5\times10^{-4}$ mol, per mol of silver.

The infrared sensitizing dyes to be used in the present invention can be directly dispersed in the emulsion. Alternatively, they may be first dissolved in a suitable solvent such as methyl alcohol, ethyl alcohol, methyl cellosolve, acetone, water, pyridine, or a mixture thereof to add them to the emulsion as a solution. Processes for adding the infrared sensitizing dyes to the photographic emulsion are described, for example, in U.S. Pat. Nos. 3,469,987, 3,676,147, 3,822,135, 4,199,360, and in U.S. Pat. Nos. 2,912,343, 3,342,605, 2,996,287 and 3,429,835. The aforesaid infrared sensitizing dyes may be uniformly dispersed in the silver halide emulsion before coating on a suitable support. Of course, this dispersing procedure may be conducted in any step of preparing the silver halide emulsion.

The ratio (by weight) of the amount of the infrared sensitizing dye to that of the compound represented by the general formula (I) may be in any effective proportion and is advantageously 1/1 to 1/30, particularly advantageously 1/2 to 1/50.

Infrared sensitive silver halide color photographic elements for use in the present invention are preferably those described in U.S. Pat. No. 4,619,892, which is incorporated herein by reference. More preferably, the infrared sensitive silver halide color photographic elements for use in the present invention are those having all of the silver halide emulsion layers sensitized to different infrared regions of the electromagnetic spectrum. The order of these layers respect to the support, the difference in emulsion sensitivity among the layers and the sensitivity, contrast and D-max of each layer are preferably those described in said U.S. Pat. No. 4,619,892.

Any of the various types of photographic silver halide emulsions may be used in the practice of the present invention. Silver chloride, silver bromide, silver iodobromide, silver chlorobromide, silver chloroiodobromide, and mixture thereof may be used, for example, dispersed in a hydrophilic colloid or carrier. Any configuration of grains, cubic, orthorombic, hexagonal, epitaxial, or tabular (high aspect ratio) grains may be used. The colloid may be partially hardened or fully hardened by any of the variously known photographic hardeners. Such hardeners are free aldehydes, aldehyde releasing comounds, triazines and diazines, aziridines, vinylsulfones, carbodiimides, and the like may be used, as described, for example, in U.S. Pat. Nos. 3,232,764, 2,870,013, 3,819,608, 3,325,287, 3,992,366, 3,271,175 and 3,490,911.

The silver halide photographic elements can be used to form dye images therein through the selective formation of dyes. The photographic elements described above for forming silver images can be used to form dye images by employing developers containing dye image formers, such as color couplers, as described, for example, in U.S. Pat. Nos. 3,111,864, 3,002,836, 2,271,238, 2,236,598, 2,950,970, 2,592,243, 2,343,703, 2,376,380, 2,369,489, 2,899,306, 3,152,896, 2,115,394, 2,252,718, 2,108,602, and 3,547,650. In this form the developer contains a color developing agent (e.g., a primary aromatic amine which in its oxidized form is capable of reacting with the coupler to form the image dye). Also, instant self-developing diffusion transfer film can be used as well as photothermographic color film or paper using silver halide in catalytic proximity to reducable silver sources and leuco dyes.

The dye-forming couplers can be incorporated in the photographic elements, as illustrated by Schneider et al., *Die Chemie*, Vol. 57, 1944, p.113, and in U.S. Pat. Nos. 2,304,940, 2,269,158, 2,322,027, 2,376,679, 2,801,171, 2,748,141, 2,772,163, 2,835,579, 2,533,514, 2,353,754, 3,409,435 and Chen, Research Disclosure, Vol. 159, July 1977, Item 15930. The dye-forming couplers can be incorporated in different amounts to achieve differing photographic effects. For example, GB Pat. No. 923,045 and U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated in U.S. Pat. Nos. 2,423,730, 2,772,162, 2,895,826, 2,710,803, 2,407,207, 3,737,316, 2,367,531, 2,772,161, 2,600,788, 3,006,759, 3,214,437, 3,253,924, 2,875,057, 2,908,573, 3,043,892, 2,474,293, 2,407,210, 3,062,653, 3,265,506, 3,384,657, 2,343,703, 3,127,269, 2,865,748, 2,933,391, 2,865,751, 3,725,067, 3,758,308, 3,779,763, 3,785,829, 3,762,921, 3,983,608, 3,311,467, 3,408,194, 3,458,315, 3,447,928, 3,476,563, 3,419,390, 3,419,391, 3,519,429, 3,222,176, 3,227,550, in GB Pat. Nos. 969,921, 1,241,069, 1,011,940, 975,928, 1,111,554, 1,248,924, and in CA Pat. No. 726,651. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated in U.S. Pat. Nos. 3,148,062, 3,227,554, 3,733,201, 3,617,291, 3,703,375, 3,615,506, 3,265,506, 3,620,745, 3,632,345, 3,869,291, 3,642,485, 3,770,436, 3,808,945, and in GB Pat. Nos. 1,201,110 and 1,236,767. Dye-forming couplers and nondye-forming compounds which upon coupling release a variety of photographically useful groups are described in U.S. Pat. No. 4,248,962. DIR compounds which do not form dye upon reaction with oxidized color developing agents can be employed, as illustrated in U.S. Pat. Nos. 3,928,041, 3,958,993, 3,961,959, 4,049,455, 4,052,213 and in German OLS Nos. 2,529,350, 2,448,063 and 2,610,546. DIR compounds with oxidatively cleave can be employed, as illustrated in U.S. Pat. Nos. 3,379,529, 3,043,690, 3,364,022, 3,297,445 and 3,287,129. Silver halide emulsions which are relatively light insensitive, such as Lipmann emulsions, having been used as interlayers or overcoat layers to prevent or control the migration of development inhibitor fragments as described in U.S. Pat. No. 3,892,572.

The photographic elements can incorporate colored dye-forming couplers, such as those employed to form integral masks for negative color images, as illustrated in U.S. Pat. Nos. 2,449,966, 2,521,908, 3,034,892, 3,476,563, 3,519,429, 2,543,691, 3,028,238, 3,061,432, and/or competing couplers, as illustrated in U.S. Pat. Nos. 3,876,428, 3,580,722, 2,998,314, 2,808,329, 2,742,832 and 2,689,793.

As previously noted, the color provided in the image produced by exposure of each of the differently sensitized silver halide emulsion layers does not have to be produced by color coupler reaction with oxidized color developers. A number of other color image forming mechanisms well known in the art can also be used. Amongst the commercially available color image forming mechanisms are the diffusion transfer of dyes, dye-bleaching, and leuco dye oxidation. Each of these procedures is used in commercial products, is well understood by the ordinary skilled photographic artisan, and is used with silver halide emulsions. Multicolor elements using these different technologies are also commercially available. Converting the existing commercially available systems to the practice of the present invention could be done by routine redesign of the sensitometric parameters of the system and/or the addition of intermediate filter layers as described in U.S. Pat. No. 4,519,892. For example, in a conventional instant color dye-diffusion transfer element, the sensitivity of the various layers and/or the arrangement of filter layers between the silver halide emulsion layers would be directed by the teachings of the above U.S. patent, the element otherwise remaining the same. This would be true with either negative-acting or positive-acting silver halide emulsions in the element. The only major, and fairly apparent, consideration that must be given to such construction is to insure that the placement of any filter layers does not prevent transfer of the diffusion dye to a receptor layer within the element. Using a filter which is not a barrier layer between the receptor layer and the dye-containing layer is the simplest way to address that consideration. Such a layer should not prevent migration of the diffusion dye across the filter layer.

These types of imaging systems are well known in the art. Detailed discussions of various dye transfer, diffusion processes may be found for example in "A fundamentally New Imaging Technology for Instant Photography", W. T. Harison, Jr., Photographic Science and Engineering, Vol. 20, No. 4, July/August 1976, and Neblette's Handbook of photography and Reprography, Materials, Processes and Systems, 7th Edition, John. M. Stunge, van Nostrand Reinhold Company, N.Y., 1977, pp. 324–330 and 126. Detailed discussion of dye-bleach color imaging systems are found for example in The Reproduction of Colour, 3rd Ed., R. W. G. Hunt, Fountain Press, London, England, 1975, pp.325–330; and The Theory of the Photographic Process, 4th Ed., Mees and James, Macmillan Publishing Co., Inc., N.Y., 1977, pp. 363–366. Pages 366–372 of Mees and James, supra, also discuss dye-transfer processes in great detail. Leuco dye oxidation in silver halide systems are disclosed in such literature as U.S. Pat. Nos. 4,460,681, 4,374,821, and 4,021,240. Diffusion photothermographic color image forming systems such as those disclosed in GB Pat. Appln. No. 3,100,458 are also useful in the practice of the present invention.

The photographic elements can include image dye stabilizers. Such image dye stabilizers are illustrated in U.S. Pat. Nos. 3,432,300, 3,698,909, 3,574,627, 3,573,050, 3,764,337, and 4,042,394 and in GB Pat. No. 1,326,889.

Filter dyes can be included in the photographic elements. Said dyes must be selected on the basis of their radiation filtering characteristics to insure that they filter the appropriate wavelengths. Filter dyes and their methods of incorporation into the photographic elements are well documented in the literature such as U.S. Pat. Nos. 4,440,852, 3,671,648, 3,423,207, and 2,895,955, GB Pat. No. 485,624, and Research Disclosure, Vol. 176, December 1978, Item 17643. Filter dyes can be used in the practice of the present invention to provide room-light handleability to the elements. Dyes which will not allow transmission of radiation having wavelengths shorter than the shortest wavelength to which one of the emulsion layers has been sensitized can be used in a layer above one or more (preferably all) of the emulsion layers. The cut-off filter dye preferably does not transmit light more than approximately 50 nm less than the shortest wavelength to which any of the emulsion layers have been sensitized. Filter dyes should also be provided with non-fugitive (i.e., non-migratory) characteristics and should be decolorizable (by bleaching in developer or heat, for example) or leachable (e.g., removed by solvent action of any baths).

Other conventional photographic addenda such as coating aids, antistatic agents, acutance dyes, antihalation dyes and layers, antifoggants, latent image stabilizers, antikinking agents, high intensity reciprocity failure reducers, and the like may also be present.

The following examples illustrate a general synthetic procedure which may be used in the preparation of 5-arylamino-1,2,3,4-thiatriazole derivatives and non-limiting examples of preferred embodiments of the present invention.

EXAMPLE 1

Preparation of 5-(4-ethoxycarbonylphenyl)-amino-1,2,3,4-thiatriazole a) 0.1 Mol of ethyl p-aminobenzoate was mixed with 150 ml of water and stirred for 15 minutes. Thiophosgene (10 g) in 50 ml chloroform was added dropwise. The mixture was stirred for 2 hours at 15° C. The organic solution was washed with HCl 2N, dried and the solvent was removed under vacuum to obtain a yellow-red oil, that was used as crude product. 0.02 mMole of the obtained 4-ethoxycarbonylphenylisothiocyanate and 30 ml ethanol were stirred in a flask and added dropwise with 2 ml 85% hydrazine in 2 ml water. After 15 minutes the crude product separated and was filtered under vacuum. Yield 90%. 0.01 Mole of the obtained 4-ethoxycarbonylphenylthiosemicarbazide was mixed with a solution of 1.5 ml HCl 37% and 35 ml water. The mixture was cooled to 5° C. and 0.8 g sodium nitrite dissolved in 5 ml water was added dropwise. The mixture was stirred for 30 minutes at 5° C. The crude product was filtered, washed with water and dried. Yield 80%. The product was crystallized from methanol. The structure was confirmed by IR and NMR spectroscopy.

EXAMPLE 2

A photographic emulsion was prepared by precipitation of AgCl and conversion to AgBr to provide an emulsion with 85% bromide and 15% chloride with an average grain size of 0.9 μm. The emulsion was chemically digested with sodium thiosulfate, added with a dispersion of the cyan dye forming coupler A in a water-insoluble high boiling organic solvent to have a coupler amount of 164.68 g per mol of silver, with 1-phenyl-5-mercaptotetrazole as supersensitizer and stabilizer in a quantity of 51.7 micromol per mol of silver and sensitized to the 895 nm region of the spectrum with dye B in the quantity of $45.5\times10^{-6}$ mol per mol of silver. This emulsion, added with conventional surfactants and hardeners, was coated onto a paper support so that the coating silver and the cyan dye forming coupler weights are 0.42 g/m$^2$ and 0.64 g/m$^2$, respectively (Reference film 1).

Following the procedure described for film 1, films 2 and 3 according to this invention were prepared on substitution of 1-phenyl-5-mercaptotetrazole with 272.4 micromol and 544.8 micromol per mole of silver, respectively, of 5-(4-ethoxycarbonylphenyl)amino-1,2,3,4-thiatriazole.

Following the procedure described for film 1, comparison films 4 and 5 were prepared on substitution of 1-phenyl-5-mercaptotetrazole with 324.1 micromol and 648.2 micromol per mole of silver, respectively, of 5-(4-chlorophenyl)amino-1,2,3,4-thiatriazole of U.S. Pat. 4,780,404.

Samples of the films were stored for 24 hours to 21%, 50% and 80%, respectively, relative humidity, then each sample was sealed in a sealed bag and stored for three days at 35° C. Each of the film samples was exposed through an optical wedge using an infrared sensitometer. After exposure, these samples were processed in a standard Kodak EP-2 processing color chemistry with conditions similar to those stated in U.S. Pat. No. 4,346,873.

After processing, status D densitometry was measured. Table 1 reports the variations of sensitivity versus the reference sample stored at 50% relative humidity (S) and the change in sensitivity among samples stored at 21% and 50% relative humidity ($dS_1$) and among samples stored at 21% and 50% relative humidity ($dS_2$). The values of sensitivity are expressed in log E units necessary to have an optical density of 1.0.

TABLE 1

| Film | S | $dS_1$ | $dS_2$ |
|---|---|---|---|
| 1 | 1.00 (ref.) | +0.10 | −0.38 |
| 2 | +0.35 | +0.04 | −0.31 |
| 3 | +0.22 | +0.02 | −0.31 |
| 4 | +0.08 | +0.02 | −0.32 |
| 5 | −0.29 | +0.02 | −0.29 |

Coupler A:

-continued

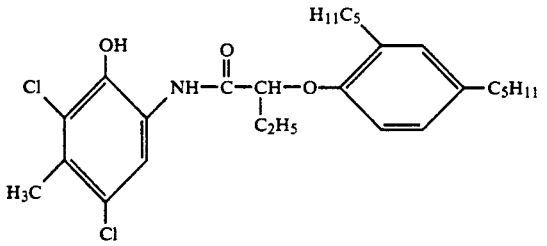

Dye D:

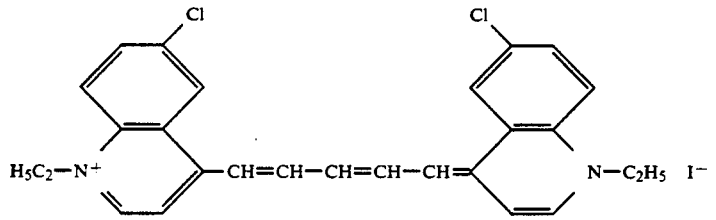

EXAMPLE 3

A photographic emulsion was prepared by precipitation of AgCl and conversion to AgBr to provide an emulsion with 85% bromide and 15% chloride with an average grain size of 0.9 micrometers. The emulsion was chemically digested with sodium thiosulfate, added with a dispersion of the yellow dye forming coupler C in a water-insoluble high boiling organic solvent to have a coupler amount of 157.95 g per mol of silver, with 1-phenyl-5-mercaptotetrazole as supersensitizer and stabilizer in a quantity of 9.8 micromol per mol of silver and sensitized to the 760 nm region of the spectrum with dye D in the quantity of $258.4\times10^{-6}$ mol per mol of silver. This emulsion, added with conventional surfactants and hardeners, was coated onto a paper support so that the coating silver and the cyan dye forming coupler weights are 0.56 g/m$^2$ and 0.84 g/m$^2$, respectively (Ref. film 1).

Following the procedure described for film 1, films 2 and 3 according to this invention were prepared on substitution of 1-phenyl-5-mercaptotetrazole with 179.5 micromol and 359 micromol per mole of silver, respectively, of 5-(4-ethoxycarbonylphenyl)amino-1,2,3,4-thiatriazole.

Samples of the films were stored for 24 hours to 21%, 50% and 80% relative humidity, respectively, then each sample was sealed in a sealed bag and stored for three days at 33° C.

Each of the film samples was exposed through an optical wedge using an infrared sensitometer. After exposure, these samples were processed in a standard Kodak EP-2 processing color chemistry with conditions similar to those stated in U.S. Pat. No. 4,346,873.

After processing, status D densitometry was measured. Table 2 reports the variations of sensitivity versus the reference sample stored at 50% relative humidity (S) and the change in sensitivity among samples stored at 21% and 50% relative humidity ($dS_1$) and among samples stored at 21% and 50% relative humidity ($dS_2$). The values of sensitivity are expressed in log E units necessary to have an optical density of 1.0.

TABLE 2

| Film | S | $dS_1$ | $dS_2$ |
|---|---|---|---|
| 1 | 1.00 (ref.) | +0.06 | −0.24 |
| 2 | +0.13 | 0.00 | −0.16 |
| 3 | +0.16 | 0.00 | −0.06 |

Coupler C:

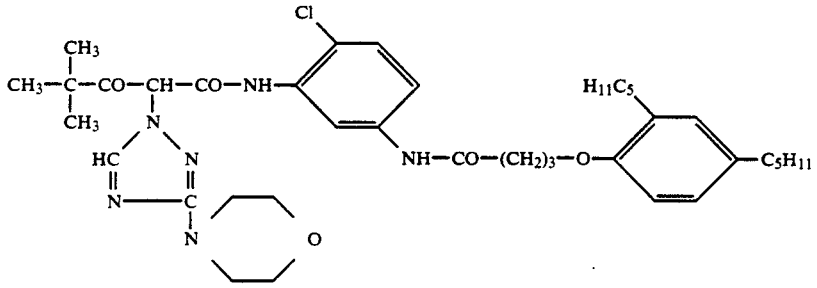

Dye D:

-continued

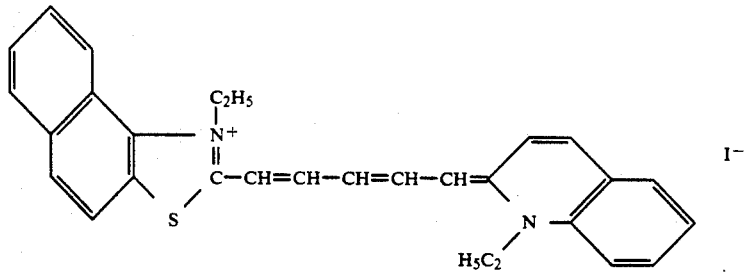

We claim:

1. A silver halide photographic element comprising a support and at least one silver halide emulsion layer spectrally sensitized to the infrared portion of the electromagnetic spectrum, characterized in that said infrared sensitized silver halide emulsion layer comprises a supersensitizing and stabilizing amount of a 5-arylamino-1,2,3,4-thiatriazole compound in which the aryl group has at least one electron-withdrawing group substituent selected from the group consisting of straight or branched alkoxycarbonyl groups with 1 to 4 carbon atoms.

2. The photographic element of claim 1 wherein the aryl group is a phenyl group.

3. The photographic element of claim 1 wherein the 5-arylamino-1,2,3,4-thiatriazole compound is present in an amount from about 0.008 g to about 0.280 g per mole of silver halide.

4. The photographic element of claim 1 wherein the silver halide emulsion associated with said 5-arylamino-1,2,3,4-thiatriazole compound is sensitized by a dye selected form the class consisting of thia-, benzothia-, seleno-, benzoseleno-, imida-, benzoimida-, oxa-, benzoxa-, and enamine tricarbocyanines.

* * * * *

UNITED STATES PATENT AND TRADEMARK OFFICE

CERTIFICATE OF CORRECTION

PATENT NO. : 5,232,826

DATED : August 3, 1993

INVENTOR(S) : Bucci et al.

It is certified that error appears in the above-indentified patent and that said Letters Patent is hereby corrected as shown below:

Column 2, line 8, delete "U.S. Pat. No. 4,578,347," and insert --U.S. Pat. No. 4,011,083, triaryl compounds described in U.S. Pat. No. 4,578,347--.

Column 10, line 55, in Table I, Film, 3, under $dS_1$, delete "+0.02" and insert --+0.01--.

Signed and Sealed this

Twenty-seventh Day of September, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,232,826

DATED : August 3, 1993

INVENTOR(S) : Bucci et al.

It is certified that error appears in the above-indentified patent and that said Letters Patent is hereby corrected as shown below:

Column 2, line 8, delete "U.S. Pat. No. 4,578,347," and insert --U.S.Pat. No. 4,011,083, triaryl compounds described in U.S. Pat. No. 4,578,347--.

Column 2, line 29, delete "wich" and insert --which--.

Column 10, line 55, in Table I, Film, 3, under $dS_1$, delete "+0.02" and insert --+0.01--.

This certificate supersedes Certificate of Correction issued September 27, 1994.

Signed and Sealed this

First Day of November, 1994

*Attest:*

*Attesting Officer*

Bruce Lehman

BRUCE LEHMAN

*Commissioner of Patents and Trademarks*